United States Patent [19]

Goebel et al.

[11] Patent Number: 5,018,327

[45] Date of Patent: May 28, 1991

[54] PREFABRICATED PLATE ELEMENTS FOR THE CONSTRUCTION OF INSULATING CHAMBERS

[75] Inventors: Rudolf A. Goebel, Brunisried, Switzerland; Konrad Stolzlechner, Brunico, Italy

[73] Assignee: Aelos Holding AG, Heerbrugg, Switzerland

[21] Appl. No.: 203,344

[22] Filed: May 31, 1988

[30] Foreign Application Priority Data

Jul. 31, 1986 [IT] Italy ..... 4837 A/86

[51] Int. Cl.[5] ..... F16S 1/00

[52] U.S. Cl. ..... 52/282; 52/805; 52/404

[58] Field of Search ..... 52/802, 803, 804, 805, 52/282, 309.11, 394, 404, 582, 809; 220/307

[56] References Cited

U.S. PATENT DOCUMENTS

| | | | |
|---|---|---|---|
| 564,060 | 7/1896 | Draper | 220/307 |
| 1,124,660 | 1/1915 | Rapp | 52/804 X |
| 1,708,351 | 4/1929 | Auld | 52/803 X |
| 1,764,668 | 6/1930 | Woodall et al. | 52/805 X |
| 1,856,941 | 5/1932 | Anderson | 220/307 |
| 2,082,614 | 6/1937 | Brodrick | 270/307 X |
| 2,579,157 | 12/1951 | Price, Sr. et al. | 52/805 |
| 2,622,710 | 12/1952 | Haas | 52/404 X |
| 3,267,626 | 8/1966 | Daly | 52/805 X |
| 3,333,385 | 8/1967 | King | 52/805 X |
| 3,420,029 | 1/1969 | Martin | 52/804 X |
| 4,326,365 | 4/1982 | Svensson | 52/582 X |
| 4,589,240 | 5/1986 | Kendall et al. | 52/805 X |

FOREIGN PATENT DOCUMENTS

| | | | |
|---|---|---|---|
| 683760 | 7/1966 | Belgium . | |
| 3520500 | 1/1986 | Fed. Rep. of Germany . | |
| 693443 | of 1930 | France | 220/307 |
| 1358454 | 3/1964 | France . | |
| 84912 | 3/1965 | France . | |
| 88656 | 3/1967 | France . | |
| 650877 | of 1963 | Italy | 52/582 |
| 530069 | of 1940 | United Kingdom | 220/307 |
| 842939 | 7/1960 | United Kingdom | 52/805 |

*Primary Examiner*—David A. Scherbel
*Assistant Examiner*—Jerrold D. Johnson
*Attorney, Agent, or Firm*—Horst M. Kasper

[57] ABSTRACT

The prefabricated panel elements for the construction of insulating chambers consist of an interlocking element (1) surrounding an insulating core, and of a cover (2). The interlocking element and the cover can be either attached to each other or to a support structure. The panel elements are assembled to form walls and insulating chambers, in particular for the installation of air conditioning equipment, cooling plant and similar.

8 Claims, 1 Drawing Sheet

PREFABRICATED PLATE ELEMENTS FOR THE CONSTRUCTION OF INSULATING CHAMBERS

DESCRIPTION

1. Technical Field

Figure 2:
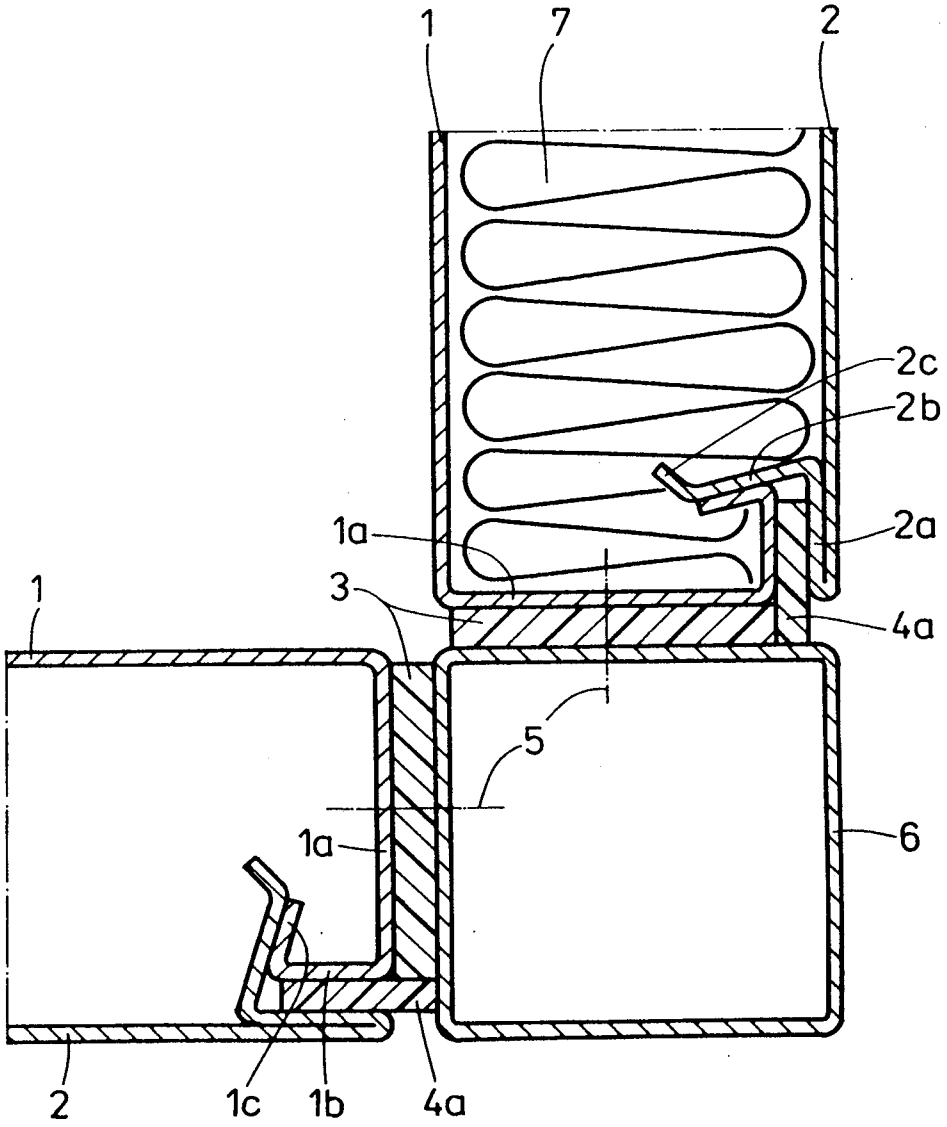

Casings for the installation of air-conditioning, cooling, or ventilation apparatus.

2. State of the Art

The construction of thermally and/or acoustically insulated casings for receiving air-conditioning apparatus, cooling apparatus, and the like is known, which are usually disposed in the basement or in the attic, or outside of the building.

These casings are made of plate elements with standardized dimensions and exhibit an inner insulating layer, which are covered with sheet metal on the outside. The mounting together of the elements themselves or, respectively, the attachment of these elements to a supporting structure, is performed by means of connection elements or attachment elements, which are attached to the plate elements or which are formed as a single piece at the plate elements. Such plate elements are known from the description of the U.S. Pat. No. 3,372,520, of the French Pat. No. 927,270, of the U.S. Pat. No. 3,670,466, and of the German Patent Laid Out DE-A 3,042,109.

All these conventional plate elements, including those which are subject-matter of the above patent literature, are concerned with elements which surround the insulating core on all sides and which exhibit on the outside grooves, ribs, protrusions, clamps or other mutual connection and attachment elements. The production of such plate elements thus requires the use of profiles with a branched cross-section, a sheet metal cut to size, as well as various attachment elements, where the latter are formed or attached as a single piece at the plate elements. The production of the plate element occurs in various work processes by means of specific equipment. The mounting together of the plate elements to casings in contrast requires work phases, such as screwing together, insertion of studs or locking screws, alignment of protrusions or the like. Furthermore, at the positions of the application of the attachment elements, the corrosion-resistant layer can be damaged easily, and corrosion-susceptible outer and/or inner faces are generated, at which dust and condensation water can be deposited and, finally, an unfavorable electro-chemical effect occurs based on the mutual contacting of various metals. In addition, such faces are not smooth and thus are difficult to keep clean and therefore look unesthetical.

DESCRIPTION OF THE INVENTION

It is an object of the invention to provide for a plate element as described above. The attachment and mounting elements of said plate element are not visible from the outside. The plate element is provided with smooth outer surfaces and exhibits an inner attachment system in a protected region. The attachment system of the plate element is easily accessible after mounting of the plate element. Furthermore, the plate element is resistant to corrosion at the metallic contact points of various pieces, such as attachment elements. Said plate element can be economically manufactured.

This object is achieved according to the invention by employing a box-shaped flat element which can be closed by a snap-on cover and which box-shaped element is filled with insulating material. The box-shaped element as well as the cover can be made of sheet metal or of a plastic laminate.

The elastically deformable members, forming the snap connection between the box-shaped element and the cover, are preferably made as a single piece with the respective element and they enhance in particular the required stiffening of the element. However, it is not excluded that elastic parts out of various materials are applied at one or both elements. The snap connection between the box-shaped element and the cover is preferably of the kind which allows a later demounting of the cover. The insulating layer placed in the box-shaped element is preferably of a soft and/or bendable kind, such as glass fiber or the like, however, the application of stiff or composed insulating plates, such as stiff-bendable, is not excluded.

The connection of the plate elements according to the invention between themselves or with a supporting structure with or without insertion of seals, inserts, or the like, comprises the use of conventional elements used in the sheet metal and laminate processing. These elements are applied on the inside of box-shaped elements before the insertion of the insulating layer and before the snapping on of the cover. Bores can already be provided for the placing of these attachment elements which are, for example, tapping screws, sheet metal screws, blind rivets, or the like, or they can be produced during mounting in a simple fashion at the desired locations. The area for the application of the attachment elements is usually the narrow continuous edge determining the depth of the box-shaped elements. However, for the forming of edges or subdividing walls, it is not excluded to place them at the floor of the box-shaped element. Furthermore, it is possible to connect the box-shaped elements and the floor to each other. According to the invention, the represented connection system allows in addition the simple attachment of the plate elements to profiles and to walls in general, which represent for example the supporting structure of the casing, respectively of the aggregate to be insulated. Furthermore, this attachment system is also applicable for the mounting of tie rods, of tension rods, of bearings, of supports, and the like, in particular at the inner side of the casings. Seals, inserts, or shim stock can be inserted between the adjoining faces of the connected plate elements, which seals, inserts, or shim stock can be maintained in a desired position by way of the described attachment elements.

According to the invention, ribs or the like can be provided at the cover as well as at the floor of the box-shaped element in order to enhance the form stability. For the same purpose, elastic arms can also be provided at the edges of the cover or, respectively, there can be used the inwardly protruding wings of the box-shaped elements, which form the snap connection.

In addition, a sealing or an insert or a shim stock can be inserted between the continuous edge of the cover and the corresponding stop at the box-shaped element. The effect of the elastic tongue at the wing, which forms the seat of the snap connection, is such that a pull of the cover is performed toward the box-shaped element, whereby the possibly inserted seal is subjected to pressure. The invention does not exclude the application of conventional elastic elements for forming of the snap connection between the cover and the box-shaped element.

The potentially corrosion-resistant surface treatment of the box-shaped element and of the cover can, according to the connection system of the invention, always only be damaged at an internally disposed and thus covered region.

SHORT DESCRIPTION OF THE DRAWING

The invention is explained in more detail by way of an embodiment of invention plate elements illustrated in the accompanying drawings. This schematic representation has a purely explanatory and not a limiting purpose.

Figure 1:
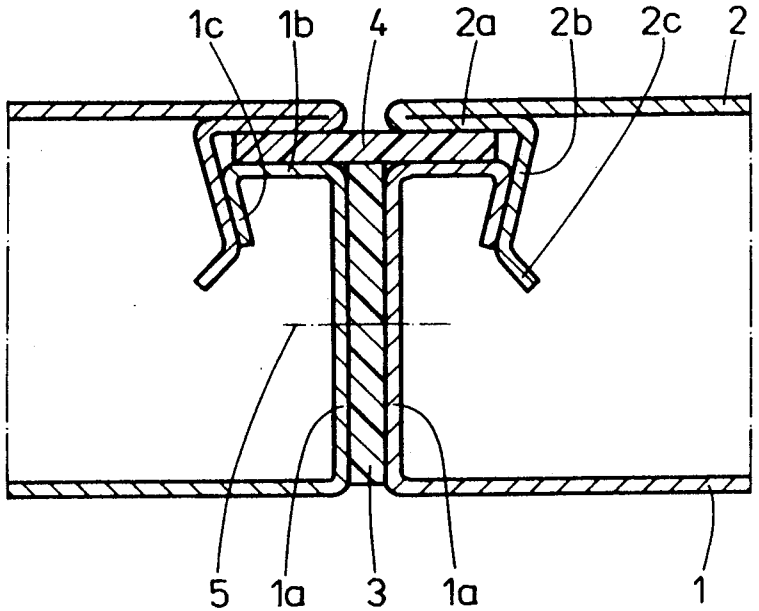

FIG. 1 illustrates the cross-section through the connection location of two invention plate elements, disposed in the same plane, FIG. 2 shows the cross-section through the connection location of two invention plate elements, which are attached at a profile at a right angle to each other.

METHOD FOR THE IMPLEMENTATION OF THE INVENTION

The box-shaped element exhibits a continuous wall 1*a*, which determines the depth of the box. This wall continues in a stop 1*b*, which extends in a plane disposed parallel to the floor and which ends in a wing 1*c*, which is inclined toward the continuous wall 1*a*. In particular, the stop 1*b* and the wing 1*c* contribute much in that a substantial form stability is imparted to the box-shaped element 1. The cover 2 exhibits a folded-together strip 2*a* in the region of the continuous edge, which folded-together strip 2*a* ends in an elastic arm 2*b* with the insertion bevel 2*c*. The elastic arm 2*b* with the insertion bevel 2*c* can extend over the full length of the sides or it can be limited to certain regions. The folded-together strip 2*a* as well as the elastic arm 2*b* with the insertion bevel 2*c* can contribute to the form stability of the cover and this is the case in particular where the latter extend continuously over all sides. The elastic arm 2*b*, with reference to the cover 2, is inclined toward the outside and effects, by way of the elastic tension, by resting at the inclined wing 1*c* of the box-shaped element 1, the connection between the two parts (1–2) without excluding a later demounting.

The mounting together of the plate elements themselves is performed according to the invention, before the insertion of the insulating layer 7 and the snapping on of the cover 2, by way of attachment elements 5, which penetrate the adjoining walls of the box-shaped elements (FIG. 1) or, respectively, which penetrate the walls of the box-shaped elements and those of an adjoining profile or the like (FIG. 2). There can be inserted seals 3, 4, 4*a* or inserts or shim stocks between the stop 1*b* of the box-shaped element 1 and the corresponding region of the cover 2, as well as in the attachment region between the box-shaped element 1, as well as between the latter and the supporting structure 6.

According to the invention, the insulating layer 7, which can be attached at the cover 2, can be inserted separately or upon snapping on of the cover 2 onto the box-shaped element 1.

COMMERCIAL APPLICATION

The particularly economic mode of production of the parts forming the plate elements, as well as their form stability and the substantial functional capability, together with the time-saving simple mounting, are inducements to employ the plate elements, in addition to the construction of insulating chambers, also for wall coverings and for the insulation of movable aggregates.

We claim:

1. Prefabricated plate element for the construction of insulating chambers, insulating walls, as well as coverings, which comprises a cover providing a substantially planar outer surface for the plate element;

a box-shaped sheet metal part (1) having an insulating filling (7), characterized in that between said box shaped sheet metal part (1) and said cover (2) there is provided a snap connection which can be repeatedly released without causing any damage to the snap connection, which snap connection exhibits two oppositely disposed and parallel running support faces and two extension sections adjoining to the respective parallel running support faces and bent relative to respective one of the two support faces in a direction away from said planar outer surface of the cover and wherein the extension sections are in direct contact for forming a form-stable connection between the cover and the box-shaped sheet metal part;

a first seal disposed between said support faces, said first seal disposed substantially in parallel to the planar outer surface.

2. The prefabricated plate element as defined in claim 1 additionally including attachment elements disposed within said box-shaped metal part, whereby said plate elements may be attached to another such plate element or an existing structure through the penetration of said box-shaped metal part by said attachment elements.

3. Mounting system between prefabricated plate elements for creating a flat wall and a wall edge, comprising a first cover (2);

a second cover;

a first box-shaped element (1) having a substantially planar outer surface and having an attached continuous wall; a second box-shaped element having a substantially planar outer surface and having an attached continuous wall; an insulating filling disposed inside the first and second box-shaped element;

characterized in that a mutual connection between the box-shaped elements or between these box-shaped elements and a supporting structure is produced by way of conventional attachment elements (5) penetrating said continuous walls (1a) of the box-shaped elements before an insertion of said insulating filling (7) into the box-shaped elements and a snapping on of said first cover (2) onto said first box-shaped element (1); a snapping on of said second cover onto said second box-shaped element; a seal provided between sections of the respective cover and of the respective box-shaped elements which are disposed directly opposed to each other; and each said cover and each said box-shaped element having extensions directly contacting each other and wherein the extension of the cover and the box-shaped element is bent in a direction away from said sections of the cover and of the box-shaped elements, which are disposed directly opposite to each other and wherein the extension sections are in direct contact for forming a form-stable connection between the respective cover and the respective box-shaped element.

4. The mounting system between prefabricated plate elements as defined in claim 3 additionally including attachment elements disposed within said box-shaped elements, whereby said plate elements may be attached to another such plate element or and existing structure through the penetration of said box-shaped elements by said attachment elements.

5. A prefabricated plate element for constructing insulating chambers, insulating walls, as well as coverings comprising a box-shaped sheet metal part;

a cover for covering the box-shaped metal part;

an insulating filling disposed inside of the box-shaped metal part;

a snap connection furnished to the box-shaped metal part and to the cover where the snap connection can be repeatedly released without causing any damage to the snap connection, which snap connection exhibits two oppositely disposed and parallel running support faces;

an insulating layer placed between the support face;

an extension of each of these support faces mutually contacting each other directly for providing form stability to the respective box-shaped metal art and the cover.

6. A prefabricated plate element for wall construction comprising a box-shaped sheet metal part;

a cover for covering the box-shaped metal part;

an insulating filling disposed inside of the box-shaped metal part;

a first snap edge furnished on the box-shaped metal part having a section disposed substantially parallel to the cover and having an extension bent away from said cover;

a second snap edge furnished on said cover by a section opposing section of said box-shaped metal part and substantially parallel thereto, said section additionally having an extension bent substantially parallel to said extension of the box-shaped metal part wherein the first snap edge and the second snap edge form a snap connection by a direct contact of their respective extensions and are capable of repeated release without damaging the snap connection between the box-shaped metal part and the cover and wherein said section of the box-shaped metal part and said section of the cover enclose a seal.

7. The prefabricated plate element as defined in claim 6 additionally including attachment elements disposed within said box-shaped metal part, whereby said plate elements may be attached to another such plate element or an existing structure through the penetration of said box-shaped metal part by said attachment elements.

8. The prefabricated plate element as defined in claim 6 in combination with an adjoining plate element and an insulating layer, said insulating layer separating said plate elements when adjoined and preventing the plate elements from touching each other.

* * * * *